United States Patent [19]

Kissling et al.

[11] Patent Number: 4,826,454

[45] Date of Patent: May 2, 1989

[54] ELECTRICAL SHOCK-PROOF FUSE HOLDER

[75] Inventors: Rene Kissling, Reussbühl; Werner Staubli, Kriens, both of Switzerland

[73] Assignee: Schurter AG, Lucerne, Switzerland

[21] Appl. No.: 167,703

[22] Filed: Mar. 14, 1988

[30] Foreign Application Priority Data

Mar. 17, 1987 [CH] Switzerland ..... 986/87

[51] Int. Cl.[4] ..... H01R 33/95

[52] U.S. Cl. ..... 439/621; 337/213

[58] Field of Search ..... 337/195, 198, 201, 213; 439/621, 622

[56] References Cited

U.S. PATENT DOCUMENTS 4,329,006 5/1982 Gale ..... 337/213
4,411,486 10/1983 Behrendt ..... 439/622
4,481,496 11/1984 Norden ..... 337/213

FOREIGN PATENT DOCUMENTS 1176004 1/1970 United Kingdom ..... 439/622
1202346 8/1970 United Kingdom ..... 439/622

*Primary Examiner*—Gary F. Paumen
*Attorney, Agent, or Firm*—Werner W. Kleeman

[57] ABSTRACT

Two axially spaced contact pieces extend radially inwardly through an opening into a receiving tube provided in a housing and contact end caps of a fuse insert or fuselink, when the latter is in a locked position within the receiving tube. To release the fuse insert, a cradle-like carrier is rotated through an angle of approximately 180°, so that the fuse insert together with the end caps thereof are spaced and insulated from the contact pieces by the cradle of the cradle-like carrier. The cradle-like carrier including the fuse insert can now be pulled out of the housing to such an extent that barb-like elements of the cradle-like carrier abut against a stop provided at the housing. The cradle-like carrier retains the receiving tube closed by means of a closure portion of the cradle-like carrier. There is thus ensured absolute electrical shock-proof safety, in other words, there is afforded complete safety against electrical shocks.

20 Claims, 4 Drawing Sheets

ELECTRICAL SHOCK-PROOF FUSE HOLDER

BACKGROUND OF THE INVENTION

The present invention relates to a new and improved construction of an electrical shock-proof fuse holder, especially a fuse holder for a fuse insert or fuselink possessing two electrically conductive end caps mechanically connected with one another by an insulating body and electrically by a fuse wire or the like.

Generally speaking, the fuse holder of the present development is of the type comprising a housing formed of electrically insulating material comprising a receiving tube or tube member extending along a predetermined lengthwise axis. The receiving tube possesses a wall provided with an opening or recess disposed substantially parallel to the predetermined lengthwise axis. A cradle-like carrier or carrier member is removably inserted into the receiving tube and is also formed of electrically insulating material. The cradle-like carrier is locked in its work position when inserted into the receiving tube and closes the receiving tube when located in such work position. The cradle-like carrier or carrier member includes a cradle or vat extending in the direction of the predetermined lengthwise axis and formed to receive the fuse insert or fuselink which is also disposed so as to extend essentially in the direction of the predetermined lengthwise axis. To release or unlock the cradle-like carrier, the latter is turned or rotated about the predetermined lengthwise axis and, without further rotational movement or rotary motion, it is pulled out or displaced with respect to the receiving tube in the direction of the predetermined lengthwise axis such that the cradle-like carrier is in a rest position to allow replacement of the fuse insert or fuselink. Two contact pieces or contacts are each electrically conductively connected with an exterior connecting part. These two contact pieces are mounted to be electrically insulated from each other at the housing. These contact pieces extend radially resiliently and inwardly from the same side through the opening or recess into the receiving tube, thus each making electrically conducive contact with an associated end cap of the fuse insert or fuselink located in ; the cradle-like carrier which is locked in its work position. The cradle-like carrier in its released position as well as during the pulling out thereof electrically insulates the two end caps relative to the contact pieces.

A fuse holder of the aforementioned type is known, for example, from the U.S. Pat. No. 4,329,006, granted May 11, 1982. Compared with conventional fuse holders which have a contact at the base of the receiving tube engaged axially by one end cap of the fuse insert and a lateral contact which can be only indirectly contacted by the other end cap of the fuse insert via a connecting conductor of the carrier, the fuse holder described in this U.S. Pat. No. 4,329,006, has the advantage that it possesses a short overall length and a small number of components which allow for simple assembly. Electrical shock-proof safety during the course of replacing the fuse insert is ensured because the released fuse carrier insulates both end caps of the fuse insert with respect to both contact pieces located on the same side of the receiving tube while the fuse carrier is being removed from or inserted into the holder. In order to grasp the head member of the fuse carrier, it must be left in a position such that it is slightly protruding because, in contrast to fuse holders with an axial base contact, the head member does not emerge or protrude during unlocking. When the head member of the fuse carrier is fully inserted, it must be pryed out with great effort and this work cannot not be accomplished without a certain amount of danger. It is to be appreciated that when the contacts located in the receiving tube cannot be contacted from the front with the standardized test finger in accordance with the IEC (International Electrotechnical Commission) 529 Standard, also then when the fuse carrier is removed, then the fuse holder is considered to be electrically shock-proof. However, this prior art construction of the head member which can be readily manually extracted does not provide adequate protection for children. A child playing with, for instance, a thin conductive object such as a knitting-needle or the like, can poke into the fuse holder and this can cause an accident.

SUMMARY OF THE INVENTION

Therefore, with the foregoing in mind it is a primary object of the present invention to provide a new and improved construction of an electrical shock-proof fuse holder which is not associated with the aforementioned limitations and drawbacks of the prior art constructions.

Another and more specific object of the present invention aims at providing an absolutely electrical shock-proof fuse holder.

A further significant object of the present invention is directed to a new and improved construction of an electrical fuse holder composed of parts or components which are relatively simple to manufacture, so that the costs of fabrication of the fuse holder is reduced, with the parts or components being supported within the fuse holder in a highly reliable and positive manner to thereby ensure for proper operation of such fuse holder.

Yet a further noteworthy object of the present invention is to provide a new and improved construction of electrical shock-proof fuse holder which is relatively simple in construction and design, composed of relatively few parts, highly reliable in operation, easy to manipulate and use, and affords exceedingly effective protection against electrical shocks.

Now in order to implement these and still further objects of the invention, which will become more readily apparent as the description proceeds, a first embodiment of fuse holder as contemplated by the present development is manifested, among other things, by the features that connection means are provided for engagement in a thread-like manner of the cradle-like carrier and the housing with one another during the unlocking and locking operations such that the cradle-like carrier, during the course of the rotational movement for accomplishing the unlocking and locking operations, respectively, is moved in the direction of the predetermined lengthwise axis so as to respectively extend from or to be inserted into the receiving tube.

According to a second embodiment of the invention, there is provided a fuse holder which, among other things, is 1 manifested by the features that the cradle-like carrier is constructed such that it can only be extended or pulled out from the receiving tube to such an extent that replacement of the fuse insert or fuselink can be effected but the receiving tube is still protectively closed by the cradle-like carrier.

It is contemplated by the present invention to also provide a fuse holder which contains the aforenoted features of both the first and second embodiments.

Furthermore, it is to be assumed that as far as the various constructions of the inventive fuse holders are concerned the rear end of the receiving tube can be either open or closed.

While the cradle-like carrier or carrier member according to the first embodiment discussed above can be totally removed from the receiving tube or tube member, so that it would be possible to pry or poke into the receiving tube with a wire and touch the live electrical contacts, the fuse holder of the second embodiment is absolutely electrically shock-proof, because the cradle-like carrier always remains at least partially within the receiving tube and blocks access to the contacts.

It is of interest in both cases that the cradle-like carrier or carrier member can be brought into an extended or pulled out position only by means of a suitable tool, thus preventing improper manipulation and/or unwanted movement of the cradle-like carrier. For this reason, it is preferable to fully or flushly insert or sink the cradle-like carrier into the housing and to rotatably remove the cradle-like carrier by means of a suitable tool. While it is thus possible without any difficulty to accomplish the releasing or unlocking rotational or rotary motion by means of a suitable tool, for example, a screwdriver or the like, it is necessary, as hereinbefore mentioned, with the fuse holder described in the aforementioned U.S. Pat. No. 4,329,006 to remove with great difficulty the fuse carrier out of the receiving tube.

This tedious procedure is beneficially avoided with the first embodiment of the fuse holder of the present interengage with one another in a thread-like manner or what may be described as with a camming action during the locking and unlocking operations. The front end of the locked cradle-like carrier therefore can be fully inserted into a suitable recess of the housing and so-to-speak only turned or screwed out when the cradle-like carrier is unlocked or released from the housing of the fuse holder.

During the rotational movement or rotary motion for unlocking or releasing the cradle-like carrier, both end caps of the fuse insert are distanced or spaced from the contact pieces or contacts of the housing. The cradle-like carrier screens or insulates the end caps from the contact pieces because this cradle-like carrier cannot be rotated to a greater extent during the extending or pulling out operation than during the inserting operation.

Absolute electrical shock-proof safety is advantageously achieved with the second embodiment of the fuse holder and in any event and if desired with the third embodiment of the fuse holder constituting a combination of selected features of the first and second embodiments. An end portion of the cradle-like carrier remains in the receiving tube or tube member because this cradle-like carrier can only be extended or displaced to the location of a stop or abutment, for instance of annular configuration, provided within the housing. This end portion if suitably structured or if there is provided a component of the cradle-like carrier located directly outside the receiving tube, can keep the receiving tube closed, so that it is not possible to pry or poke into the fuse holder. In this surprisingly simple manner it is possible to achieve the highly desirable absolute electrical shock-proof safety of the fuse holder.

If the overall structural length of the fuse holder is unimportant, then the fuse carrier can be provided with a protruding head which can be moved without the assistance of a tool.

It is tedious or cumbersome to have to pry a fuse insert out of a cradle-like carrier or carrier member which cannot be separated from the housing. In a preferred embodiment of the invention, this is desirably avoided by rotating the cradle-like carrier about the lengthwise axis when the cradle-like carrier is in its fully extended or pulled out position. The fuse insert which preferably loosely lies in the cradle of the cradle-like carrier then can be conveniently dropped or tilted out. After rotating the cradle-like carrier back into its insertable or inwardly pushable position, the new fuse insert or fuselink can be easily placed into the cradle from above. This facilitates to a great extent replacement of the fuse insert or fuselink.

It is advantageous if the receiving tube possesses a nose member or protuberance at a side thereof which contains the opening or recess for receiving the contact pieces. This nose member or protuberance engages with a groove or slot composed of three parts or sections and disposed at the cradle-like carrier.

Near the front end of the cradle-like carrier there is provided a so-called thread or thread-like or camming groove section or part. When the nose member engages with this thread or thread-like or camming groove section or part, then rotation of the cradle-like carrier effectuates the unlocking or locking operation, as the case may be, during such time as the cradle-like carrier is being turned or screwed out of or turned or screwed into the receiving tube, respectively.

Therefore, the cradle-like carrier in its locked position or condition can be flushly inserted into the housing, so that it is releasable or unlockable only by means of a suitable tool. This affords a notable advantage in terms of safety without the need to have to resort to a larger overall structural length of the fuse holder or to have to provide further components.

An annular or ring-shaped section of the groove or slot is provided near the rear end of the cradle-like carrier. The nose member or protuberance engages with this annular or ring-shaped groove or slot when the cradle-like carrier or carrier member is in its extended or pulled out position such that the rotary motion of the cradle-like carrier or carrier member can be beneficially utilized for dropping out or releasing the fuse insert from the fuse receiving cradle or vat. On the other hand, this cradle or vat can be positioned so as to be upwardly open such that the fuse insert can be conveniently inserted without any problem. It is not necessary to fix the fuse insert in the cradle-like carrier and this is advantageous in terms of the fabrication of the cradle-like carrier and for replacement of the fuse insert or the like.

Between these aforementioned two sections or parts of the groove or slot, there is located a longitudinal groove or slot section connecting the aforementioned two groove or slot sections and extending substantially parallel to the predetermined lengthwise axis. The nose member or protuberance engages with this longitudinal groove or slot section during such time as the cradle-like carrier or carrier member is being moved into its extended or pulled out position or into its inserted or pushed in position, as the case may be, so that the cradle-like carrier or carrier member cannot rotate during these operations and the end caps of the fuse insert are thus insulated from the contact pieces.

Preferably, a number of radially resilient latching or barb-like elements are disposed at the rear end of the cradle-like carrier or carrier member, while a stop or abutment formed substantially in the shape of an undercut annular or ring-shaped shoulder is provided in the proximity of the front end of the receiving tube or tube member.

The assembly of the cradle-like carrier or carrier member in the receiving tube now can be accomplished by simply pushing the cradle-like carrier into the front side of the receiving tube, whereby the latching or barb-like elements latch behind the annular stop or abutment and thus prevent a total extraction or removal of the cradle-like carrier or carrier member. At the same time, the nose member or protuberance can be introduced into the groove or slot.

When the fuse insert is disposed in known manner substantially parallel to, however eccentrically with respect to the predetermined lengthwise axis, the fuse insert can be brought closer to the contact pieces or contacts when the carrier member or cradle-like carrier is being locked in place and further away from the contact pieces when the carrier member or cradle-like carrier is being unlocked or released. This is of advantage for purposes of making the requisite electrical contact between the contact pieces or contacts and the fuse insert and for insulating or spacing the contact pieces or contacts from the fuse insert, respectively.

Since it is unnecessary to clamp the fuse insert or fuselink in the cradle-like carrier, the cradle or vat can be advantageously structured without any openings or recesses or the like, so that the cradle-like carrier prevents access to the contact pieces in every other position with the exception of the locked position of the cradle-like carrier.

It should thus be apparent that with even a minimum of technical resources, there can be achieved a maximum of safety which may be referred to as absolute or all-insulated safety.

In the fuse holder described in the aforementioned U.S. Pat. No. 4,329,006, the contact pieces are structured to be of relatively low resiliency and disposed together with their connecting parts so close to one another, that the required insulation values are not fulfilled. Furthermore, the contact pieces are freely accessible from the outside.

In order to avoid these insufficiencies, the fuse holder in accordance with the invention can be structured such that a gap or slit is disposed in the housing between two walls, one of which is a wall of the receiving tube. This gap or slit extends on both sides of the opening or recess of the receiving tube and in circumferential direction. The electrical connection conductors or parts leading to the contact pieces are disposed in the gap or slit and they extend substantially parallel to the predetermined lengthwise axis and at both sides of the opening or recess. Therefore, the distance or spacing between the electrical connection conductors is sufficient. These electrical connection conductors lead the contact pieces to the region of the opening or recess. At the rear side or end of the housing, connecting parts or portions protruding from the electrical connection conductors or parts extend axially or laterally out of the housing. By connecting each electrical connection conductor with its related contact piece by means of a frame conductor part which extends in circumferential direction and into which the contact piece freely projects, and which contact piece extends substantially parallel to the predetermined lengthwise axis when viewed radially toward this predetermined lengthwise axis, it is possible to achieve particularly good and durable spring qualities of the contact piece.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 3:
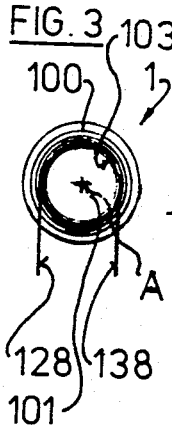
FIG. 3 is a rear view of the fuse holder, again without the switchboard or control panel and the retaining nut, as viewed in the direction of the arrow III in FIG. 1.
Figure 1:
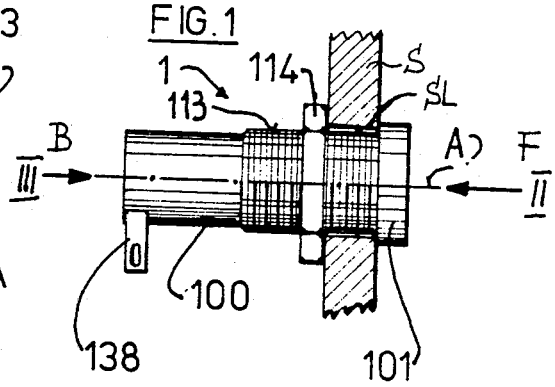
FIG. 1 is a side view of a fuse holder mounted at a switchboard or control panel, a portion of which has been shown.
Figure 4:
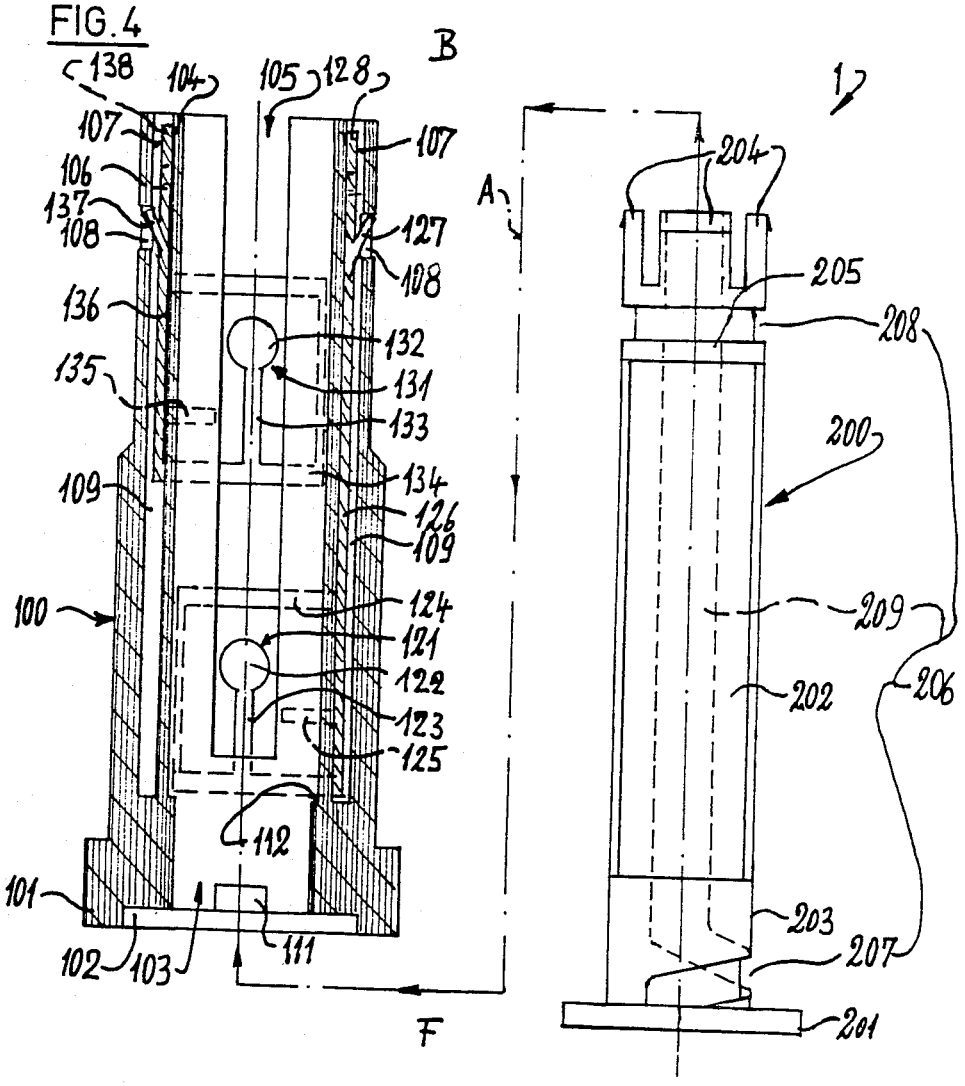
FIG. 4 shows an enlarged axial sectional view of the fuse holder depicted in FIG. 1, taken through the housing, without the cradle-like carrier, substantially taken along the line IV—IV in FIG. 2, there also being shown adjacent to the housing a top plan view of the cradle-like carrier in its rotatable position suitable for insertion for assembly in the housing.
Figure 5:
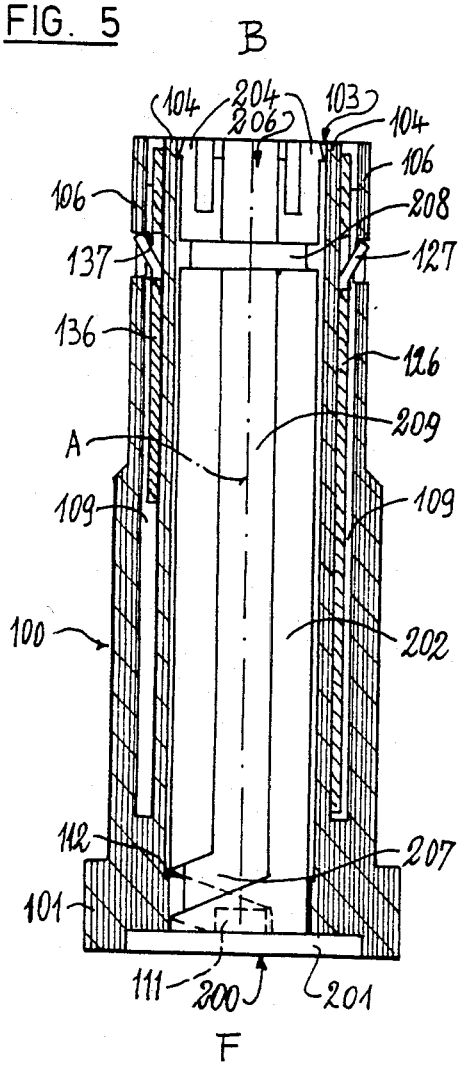
FIG. 5 illustrates, with regard to the housing, a sectional view similar to that depicted at the left side of FIG. 4 and depicting in top plan view the cradle-like carrier in its locked position within the housing shown in cross-section.

Describing now the drawings, it is to be understood that to simplify the showing thereof only enough of the construction of the fuse holder or fuse holder assembly 1 has been illustrated therein as is needed to enable one skilled in the art to readily understand the underlying principles and concepts of this invention. Turning now specifically to FIG. 1 of the drawings, there has been illustrated therein a fuse holder 1 basically composed of only four components or parts if the retaining or holding nut 114 is not considered, namely a housing or housing member 100 formed of a suitable electrically insulating plastics material and, as shown in FIG. 4, two metallic electrical contact assemblies or units 121 through 128 and 131 through 138 disposed in the housing 100 as well as a cradle-like carrier or carrier member 200 formed of electrically insulating plastics material. Because this fuse holder 1 does not require any resilient or spring parts or portions acting in the lengthwise direction, its overall structural length can be kept very small.

This fuse holder 1 can be fabricated as follows: the housing 100 and the cradle-like carrier or carrier member 200 each can be formed from a suitable plastics material in one single operation and are, for example, molded plastic parts. The two metallic electrical contact assemblies or units 121–128 and 131–138 can be stamped and bent out of suitable contact spring material.

Figure 6:
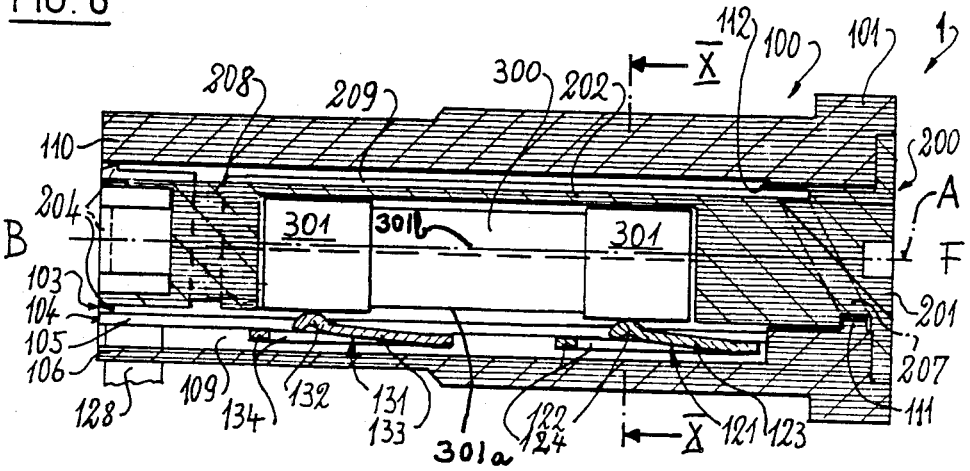
FIG. 6 shows a sectional view turned through 90° in comparison to the showing of FIG. 5 and substantially taken along the lines of VI—VI in FIG. 2 and showing the cradle-like carrier in its locked position.
Figure 7:
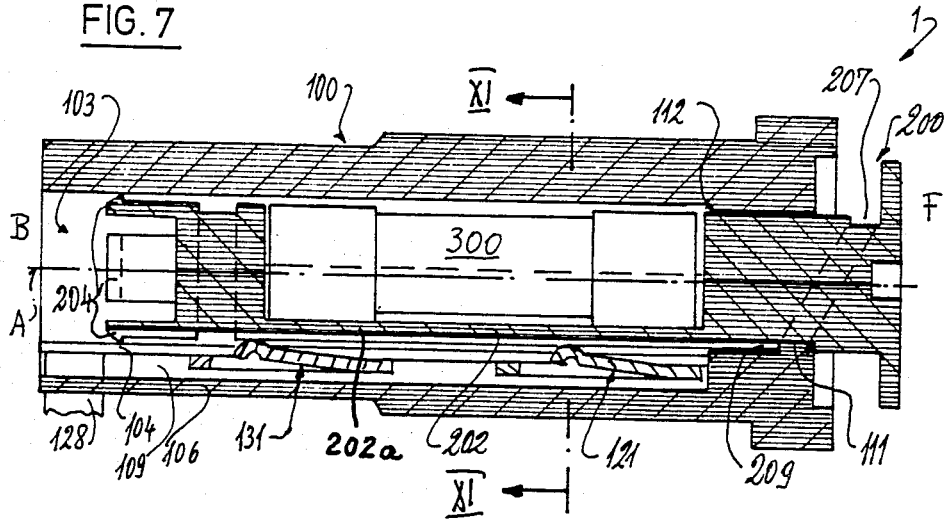
FIG. 7 is a sectional view similar to that depicted in FIG. 6, but showing the cradle-like carrier in its released position.
Figure 10:
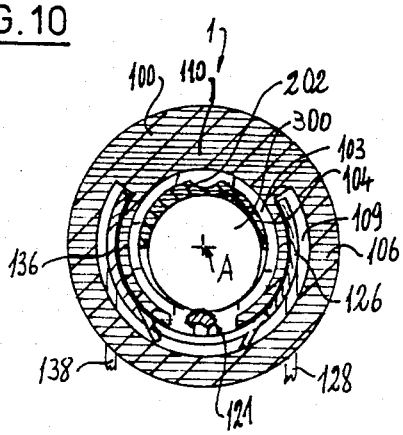
FIG. 10 illustrates a cross-sectional view taken substantially along the line X—X in FIG. 6.
Figure 11:
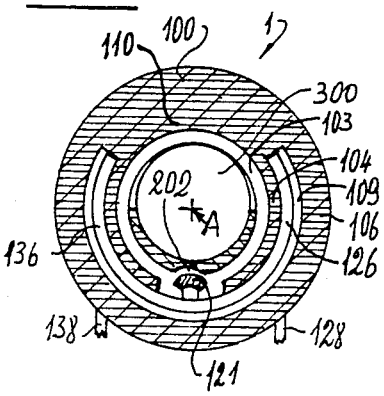
FIG. 11 illustrates a cross-sectional view taken substantially along the line XI—XI in FIG. 7.
Figure 8:
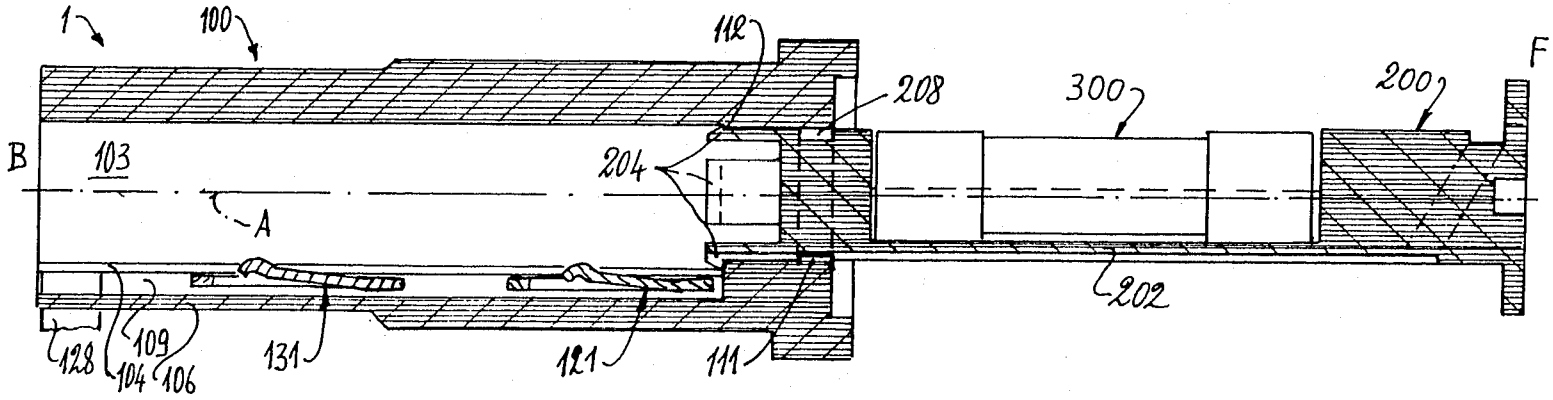
FIG. 8 is a sectional view similar to that depicted in FIG. 6, but showing the cradle-like carrier in its maximum extended or pulled out position.
Figure 9:
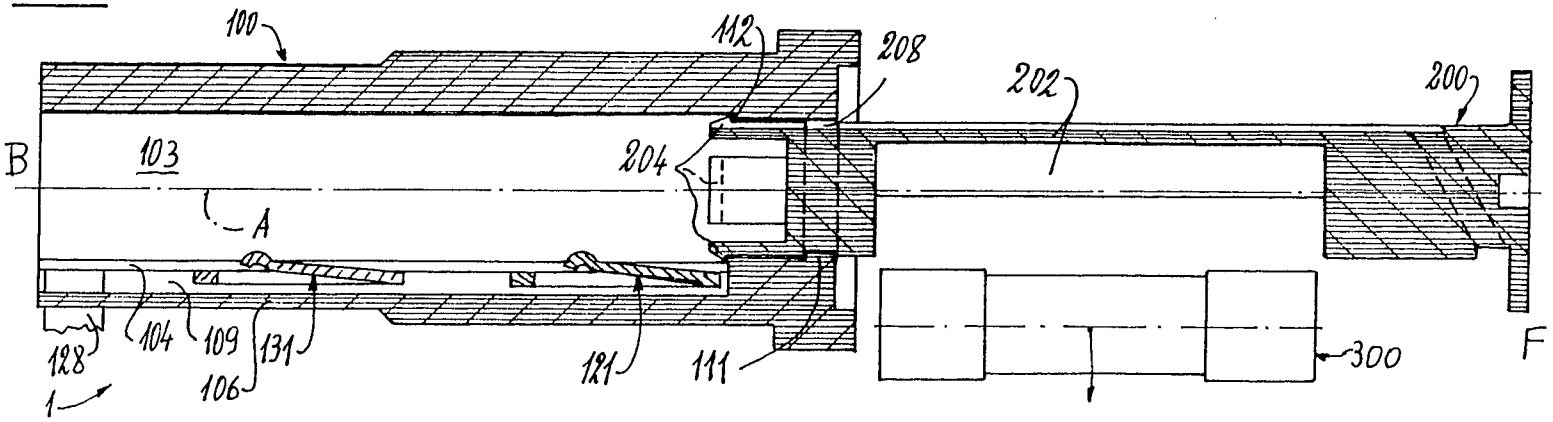
FIG. 9 is a sectional view similar to that depicted in FIG. 8, but showing the cradle-like carrier turned or rotated through an angle of 180°.

These contact assemblies or units 121–128 and 131–138 are inserted in succession from the rear end into a gap or slit 109 of the housing or housing member 100. First the contact assembly 121–128 is pushed in or inserted substantially parallel to the lengthwise axis A until it latches or snaps into the correct position. Then the other contact assembly or unit 131–138 is pushed in or inserted substantially parallel to the lengthwise axis A until it also latches or snaps into the correct position. When both these electrical contact assemblies or units 121–128 and 131–138 are in their respective proper position, the fuse holder or fuse holder assembly 1 corresponds with the illustration in FIG. 4. Now the cradle-like carrier or carrier member 200 with the latching or barb-like elements 204 leading is inserted into a receiving tube or tube member 103 of the housing or housing member 100. As a result the latching or barb-like elements 204 are first bent radially inwardly and then snap in behind a positive annular or ring-shaped stop or abutment 112 disposed in the receiving tube or tube member 103, so that the cradle-like carrier 200, as shown in FIG. 8, no longer can be detached. At this stage, the cradle-like carrier or carrier member 200, possibly provided with a fuse insert or fuselink 300, can be pushed or inserted further into the receiving tube or tube member 103 as shown in FIG. 7 and then by performing a rotational or rotary movement locked in place as shown in FIG. 6.

The lengthwise axis A of the fuse holder or fuse holder assembly 1 and of the housing 100 as well as of the receiving tube or tube member 103 is shown in all figures of the drawings. The receiving tube or tube member 103 is not visible in FIGS. 1 and 2. The front side F and the rear side B of the fuse holder 1, which sides are common to all its parts or components, are indicated in FIG. 1 and in FIGS. 4 to 9.

A sectionally illustrated switchboard or control panel portion or fragment S and the hole SL, shown somewhat on an exaggerated scale, in the switchboard or control panel portion or fragment S, in which the housing 100 of the fuse holder 1 is inserted or plugged in, as well as an external or exterior threaded portion 113 of the housing 100 and the retaining nut 114 engaging with this external threaded portion 113 are only shown in FIG. 1.

As can be seen in FIG. 1, a flange or flange member 101 rests against the front side F of the switchboard or control panel S, while the remaining part of the housing 100 is pushed through the hole SL. The retaining nut or nut member 114 engages with the external threaded portion 113 of the housing 100 so as to enable the housing 100 to be held fast or clamped in place in desired position at the switchboard or control panel S. There is also visible a connecting part or portion 138 which is here illustrated as a solder lug or tag or flag, but can also possess another form such as that of a plug or a socket.

Figure 2:
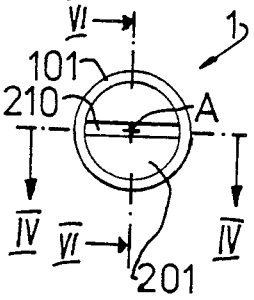
FIG. 2 is a front view of the fuse holder, without the switchboard or control panel and the retaining nut, as viewed in the direction of the arrow II in FIG. 1.

The front side of the head or head member 201 of the cradle-like carrier 200 is provided with a tool or screw driver receiving slot 210, which is particularly visible in FIG. 2. By means of a suitable tool, for example, a screw driver, the head or head member 201 fully or flushly inserted into a recess or depression 102 of the flange or flange member 101 of the housing 100 in the locked position of the cradle-like carrier or carrier member 200 can be turned or rotated to release or unlock the cradle-like carrier 200 and thereby transfer the cradle-like carrier 200 from the locked position shown in FIGS. 5 and 6 to the released or unlocked position shown in FIG. 7. In this released or unlocked position the head or head member 201 of the cradle-like carrier 200 protrudes out of the housing 100 and can be thus conveniently grasped.

This is made possible because a nose member or protuberance 111 of the housing 100 extends into the receiving tube or tube member 103 to engage with a so-called threaded or thread-like or camming groove or slot section 207 of a groove or slot 206. The threaded or thread-like or camming groove or slot section 207 is located in a front joining or connecting part or portion 203 between the head or head member 201 and a cradle or vat 202 of the cradle-like carrier or carrier member 200. This operation of the nose member or protuberance 111 which experiences a relative movement with respect to the threaded or thread-like or camming groove or slot section 207 applies to both locking and releasing or unlocking of the cradle-like carrier 200, the result depending on the direction of the rotary movement.

By virtue of the rotary or rotational movement which is effected while the cradle-like carrier 200 is being carrier 200 and with it the fuse insert or fuselink 300 lying in the cradle or vat 202 is also rotated, so that the body of the cradle or vat 202 lies in insulating or isolating manner between the contact pieces or contacts 121 and 131 and the end caps 301 of the fuse insert 300. Both electrically conductive end caps 301 are mechanically connected with each other in known manner, by means of an insulating body or tube **301*a*, and electrically by means of a fusable or meltable element or wire or the like, meely generally referred by reference character 301*b* in FIG. 6. The fuse insert 300 is disposed eccentrically with respect to the lengthwise axis A and is correspondingly rocked or turned when the cradle-like carrier 200** is being released or unlocked.

In the released or unlocked position shown in FIG. 7, the nose member or protuberance 111 is located at the front side or end of a substantially straight longitudinal groove or slot section 209 of the groove or slot 206. This longitudinal groove or slot section 209 is disposed at the rear wall **202*a* of the cradle or vat 202, so that the cradle-like carrier or carrier member 200 can now be transferred from its released or unlocked position or condition illustrated in FIG. 7 to its rest position or condition illustrated in FIG. 8 by pulling it straight out of the receiving tube or tube member 103 as far as possible, i.e. until the latching or barb-like elements 204 arranged at the rear side or end of the cradle-like carrier 200 bear against the annular stop or abutment 112 of the housing 100**.

During this pulling out or extension of the cradle-like carrier or carrier member 200, the nose member or protuberance 111 slides relatively with respect to the moved longitudinal groove or slot section 209 so that it now is positioned at the front side or end of the longitudinal or substantially linear groove or slot section 209 and arrives at the annular groove or slot section 208 disposed in the rear joining or connecting part or portion 205 between the cradle or vat 202 and the latching or barb-like elements 204 of the cradle-like carrier 200. The cradle-like carrier 200 is now free to be rotated about the lengthwise axis A in order to be brought into the fuse drop-out or tilt-out position shown in FIG. 9 for replacing the fuse insert 300, and from this position to be rotatably returned back to the rest position shown in FIG. 8. The receiving tube or tube member 103 thus always remains closed by means of the rear joining or connecting part or portion 205 which defines a closure portion or region.

The contact pieces or contacts 121 and 131 each comprise a respective contact knob or button 122 and 132 or equivalent structure disposed at a spring arm or arm member 123 and 133, respectively. Each of these spring arms 123 and 133 is part of a related frame or frame member 124 and 134, respectively. These frames or frame members 124 and 134 serve as spring or resilient suspensions and, furthermore, each comprise a supporting spring or spring member 125 and 135, respectively. For each of the two frames 124 and 134, there is provided a lead-in conductor or conductor means 126 and 136, respectively, which are of different length. These lead-in conductors 126 and 136 are, in turn, connected with their related connecting or contact portions or parts 128 and 138, respectively. In this manner, the connecting or contact portions or pieces 121 and 131 of their respective connecting from the rear end of the receiving tube 103 and therefore clearly spaced from each other. The frames 124 and 134 extend asymmetrically at different sides of the lead-in conductors or conductor means 126 and 136, such that the lead-in conductors or conductor means 126 and 136 lie on different or opposite sides of the opening or recess 105 of wall 104 of the receiving tube 103 when the contact knobs or buttons 122 and 132 are located in this opening or recess 105. There is thus afforded a good insulation from one another of the contact pieces 121 and 131, of the lead-in conductors 126 and 136 as well as of the connecting or contact portions or parts 128 and 138.

The safe and reliable mounting support of the two contact assemblies or units each comprising a contact piece, a frame, a lead-in conductor and a connecting part or portion, is effected in the gap or slit 109 between the walls 104 and 106 in such a manner that each connecting part or portion 128 and 138 is held in a related slit 107 in the outer wall 106 and unintentional release or slipping out of these connecting parts or portions 128 and 138 is prevented by the respective catch springs 127 and 137 extending into related openings or recesses 108 provided in the outer wall 106. Furthermore, a mutual contact of the contact assemblies or units is prevented by the lengthwise partition or separation portion 110 provided in the gap or slit 109.

While there are shown and described present preferred embodiments of the invention, it is to be distinctly understood that the invention is not limited thereto, but may be otherwise variously embodied and practiced within the scope of the following claims. Accordingly,

What we claim is:

1. An electrical fuse holder for a fuse insert possessing two electrically conductive end caps mechanically connected by an insulating body and electrically by a fusable element, comprising:

a housing formed of electrically insulating material;

said housing comprising a receiving tube extending along a predetermined lengthwise axis;

said receiving tube having a wall provided with an opening disposed substantially parallel to said predetermined lengthwise axis;

a carrier member removably inserted into said receiving tube and formed of electrically insulating material;

said carrier member being selectively movable with respect to said receiving tube into a work position, a release position and a rest position;

said carrier member when inserted into said receiving tube being locked in said work position and closing said receiving tube when located in said work position;

said carrier member comprising a cradle extending substantially in the direction of said predetermined lengthwise axis;

said cradle being structured to receive the fuse insert so as to be disposed therein in a direction extending substantially in the direction of said predetermined lengthwise axis;

said carrier member being unlockable from said receiving tube by rotation of said carrier member about said predetermined lengthwise axis and, without further rotational movement of said carrier member, being extendable out of said receiving tube by movement of said carrier member relative to said receiving tube in the direction of said predetermined lengthwise axis such that said carrier member assumes said rest position to allow replacement of the fuse insert;

two contact pieces provided for the fuse insert and each capable of being electrically conductively connected with an external connection part;

said two contact pieces being mounted electrically insulated from each other at said housing;

said two contact pieces extending radially resiliently and inwardly from a common side through said opening into said receiving tube;

said two contact pieces making electrical located in said carrier member when said carrier member is locked in said work position;

said carrier member in the release position and during the extension thereof out of said receiving tube electrically insulating the two end caps with respect to said contact pieces; and connection means for thread-like engagement of said carrier member with said housing during unlocking of the carrier member from the receiving tube and during locking of the carrier member with said receiving tube such that said carrier member during the course of the rotational movement thereof for unlocking the carrier member from the receiving tube and for the locking of the carrier member with the receiving tube is selectively moved in the direction of the predetermined lengthwise axis so as to respectively protrude from the receiving tube or to be inserted into said receiving tube.

2. The electrical fuse holder as defined in claim 1, wherein:

said cradle member has a front end and a rear end;

said receiving tube has a side at which there is located said opening for said contact pieces;

a nose member disposed at the side of said receiving tube at which there is located said opening for said contact pieces;

said connection means comprising groove means;

said groove means containing an annular groove section located close to the rear end of said carrier member, a groove section located close to the front end of said carrier member and a longitudinal groove section connecting said groove section located close to the front end of said carrier member with said annular groove section; and said nose member engaging with said groove means.

3. The electrical fuse holder as defined in claim 2, further including:

radially flexible and compressible barb-like elements provided at the rear end of said carrier member;

annular stop means located in said receiving tube;

said barb-like elements, when said carrier member is initially inserted into said receiving tube during assembly of said carrier member in said receiving tube, latching behind said annular stop means; and said barb-like elements during extension of said carrier member out of said receiving tube and when assuming said rest position bearing against said annular stop means so as to prevent complete removal of said carrier member from said receiving tube.

4. The electrical fuse holder as defined in claim 3, wherein:

said carrier member when locked in said work position being completely inserted into said housing such that said carrier member can only be released with the assistance of a tool; and said carrier member when assuming each of said release position and said rest position at least partially protruding from said housing.

5. The electrical fuse holder as defined in claim 4, wherein:

said carrier member being lockable in said receiving tube when assuming said work position with the assistance of a tool.

6. The electrical fuse holder as defined in claim 4, wherein:

said carrier member is structured such that said fuse insert when received in said cradle is arranged substantially parallel but eccentrically with respect to said predetermined lengthwise axis of said receiving tube.

7. The electrical fuse holder as defined in claim 6, wherein:

said cradle member is devoid of any opening.

8. The electrical fuse holder as defined in claim 7, wherein:

said housing comprises two walls;

one of said two walls being provided with said opening;

said two walls defining a slit therebetween which is disposed at opposite sides of said opening provided at said one wall of said receiving tube and extending in circumferential direction;

a respective electrical connection conductor extending substantially parallel to said predetermined lengthwise axis and disposed in said slit at each of said opposite sides of said opening;

each of said electrical connection conductors leading a related one of said external connecting parts to a related one of said contact pieces;

a respective frame conductor part connected to each electrical connection conductor and extending in said circumferential direction; and each of said contact pieces, viewed radially towards said predetermined lengthwise axis, extending substantially parallel to said predetermined lengthwise axis and projecting inwardly from said frame conductor part thereof.

9. An electrical shock-proof fuse holder for a fuse insert possessing two electrically conductive end caps mechanically connected by an insulating body and electrically by a fusable element, comprising:

a housing formed of electrically insulating material;

said housing comprising a receiving tube extending along a predetermined lengthwise axis;

said receiving tube having a wall provided with an opening disposed substantially parallel to said predetermined lengthwise axis;

a carrier member removably inserted into said receiving tube and formed of electrically insulating material;

said carrier member being selectively movable with respect to said receiving tube into a work position, a release position and a rest position;

said carrier member when inserted into said receiving tube locked in said work position and closing said receiving tube when located in said work position;

said carrier comprising a cradle extending substantially in the direction of said predetermined lengthwise axis;

said cradle being structured to receive the fuse insert so as to be disposed therein in a direction extending substantially in the direction of said predetermined lengthwise axis;

said carrier member being unlockable from said receiving tube by rotation of said carrier member about said predetermined lengthwise axis and, without further rotational movement of said carrier member, being extendable out of said receiving tube by movement of said carrier member relative to said receiving tube in the direction of said predetermined lengthwise axis such that said carrier member assumes said rest position to allow replacement of the fuse insert;

two contact pieces provided for the fuse insert and each capable of being electrically conductively connected with an external connection part;

said two contact pieces being mounted electrically insulated from each other at said housing:

said two contact pieces extending radially resiliently and inwardly from a common side through said opening into said receiving tube;

said two contact pieces making electrical conducting contact with a respective end cap of the fuse insert located in said carrier member when said carrier member is locked in said work position:

said carrier member in the release position and during the extension thereof out of said receiving tube electrically insulating the two end caps with respect to said contact pieces;

said carrier member only being extendable outwardly from said receiving tube such that replacement of the fuse insert can be effected but said receiving tube is closed at one end by said carrier member;

said carrier member in said rest position is rotatable about said predetermined lengthwise axis in order to eject the fuse insert from the cradle member;

said cradle member having a front end and a rear end;

said receiving tube having a side at which there is located said opening for said contact pieces;

a nose member disposed at the side of said receiving tube at which there is located said opening for said contact pieces;

connection means for interengaging said carrier member with said housing;

said connection means comprising groove means;

said groove means containing an annular groove section located close to the rear end of said carrier member, a groove section located close to the front end of said carrier member and a longitudinal section connecting said groove section located close to the front end of said carrier member with said annular groove section; and said nose member engaging with said groove means.

10. The electrical shock-proof fuse holder as defined in claim 9, further including:

radially flexible and compressible barb-like elements provided at the rear end of said carrier member;

annular stop means located in said receiving tube;

said barb-like elements, when said carrier member is initially inserted into said receiving tube during assembly of said carrier member in said receiving tube, latching behind said annular stop means; and said barb-like elements during extension of said carrier member out of said receiving tube and when assuming said rest position bearing against said annular stop means so as to prevent complete removal of said carrier member from said receiving tube.

11. The electrical shock-proof fuse holder as defined in claim 10, wherein:

said carrier member when locked in said work position being completely inserted into said housing such that said carrier member can only be released with the assistance of a tool; and said carrier member when assuming each of said released position and said rest position at least partially protruding from said housing.

12. The electrical shock-proof fuse holder as defined in claim 11, wherein:

said carrier member is structured such that said fuse insert when received in said cradle is arranged substantially parallel but eccentrically with respect to said predetermined lengthwise axis of said receiving tube.

13. The electrical shock-proof fuse holder as defined in claim 12, wherein:

said cradle member is devoid of any opening.

14. The electrical shock-proof fuse holder as defined in claim 13, further including:

said housing comprises two walls;

one of said two walls being provided with said opening;

said two walls defining a slit therebetween which is disposed at opposite sides of said opening provided at said one wall of said receiving tube and extending in circumferential direction;

a respective electrical connection conductor extending substantially parallel to said predetermined lengthwise axis and disposed in said slit at each of said opposite sides of said opening;

each of said electrical connection conductors leading a related one of said external connecting parts to a related one of said contact pieces;

a respective frame conductor part connected to each electrical connection conductor and extending in said circumferential direction; and each of said contact pieces, viewed radially towards said predetermined lengthwise axis, extending substantially parallel to said predetermined lengthwise axis and projecting inwardly from said frame conductor part thereof.

15. An electrical fuse holder for a fuse insert possessing two electrically conductive end caps mechanically connected by an insulating body and electrically by a fusable element, comprising:

a housing formed of electrically insulating material;

said housing comprising a receiving tube extending along a predetermined lengthwise axis;

said receiving tube having a wall provided with an opening disposed substantially parallel to said predetermined lengthwise axis;

a carrier member removably inserted into said receiving tube and formed of electrically insulating material;

said carrier member being selectively movable with respect to said receiving tube into a work position, a release position and a rest position;

said carrier member when inserted into said receiving tube being locked in said work position and closing said receiving tube located in said work position;

said carrier member comprising a cradle extending substantially in the direction of said predetermined lengthwise axis;

said cradle being structured to receive the fuse insert so as to be disposed therein in a direction extending substantially in the direction of said predetermined lengthwise axis;

said carrier member being unlocked from said receiving tube by rotation of said carrier member about said predetermined lengthwise axis and, without further rotational movement of said carrier member, being extendable out of said receiving tube by movement of said carrier member relative to said receiving tube in the direction of said predetermined lengthwise axis such that said carrier member assumes said rest position to allow replacement of the fuse insert;

two contact pieces provided for the fuse insert and each capable of being electrically conductively connected with an external connection part;

said two contact pieces being mounted electrically insulated from each other at said housing;

said two contact pieces extending radially resiliently and inwardly from a common side through said opening into said receiving tube;

said two contact pieces making electrical conducting contact with a respective end cap of the fuse insert located in said carrier member when said carrier member is locked in said work position;

said carrier member in the release position and during the extension thereof out of said receiving tube electrically insulating the two ed caps with respect to said contact pieces;

connection means for engagement of said carrier member with said housing during unlocking of the carrier member from the receiving tube and during locking of the carrier member with said receiving tube such that said carrier member during the course of the rotational movement thereof for unlocking the carrier member from the receiving tube and for the locking of the carrier member with the receiving tube is selectively moved in the direction of the predetermined lengthwise axis so as to respectively protrude from the receiving tube or to be inserted into said receiving tube;

said carrier member only being extendable outwardly from said receiving tube such that replacement of the fuse insert can be effected but said receiving tube is closed by said carrier member;

said carrier member in said rest position is rotatable about said predetermined lengthwise axis in order to eject the fuse insert from the cradle member;

said cradle member having a front end and a rear end;

said receiving tube having a side at which there is located said opening for said contact pieces;

a nose member disposed at the side of said receiving tube at which there is located said opening for said contact pieces;

said connection means comprising groove means;

said groove means containing an annular groove section located close to the rear end of said carrier member, a groove section located close t the front end of said carrier member and a longitudinal groove section connecting said groove section located close to the front end of said carrier member with said annular groove section; and said nose member engaging with said groove means.

16. The electrical shock-proof fuse holder as defined in claim 15, further including:

radially flexible and compressible barb-like elements provided at the rear end of said carrier member;

annular stop means located in said receiving tube;

said barb-like elements, when said carrier member is initially inserted into said receiving tube during assembly . of said carrier member in said receiving tube, latching behind said annular stop means; and said barb-like elements during extension of said carrier member out of said receiving tube and when assuming said rest position bearing against said annular stop means so as to prevent complete removal of said carrier member from said receiving tube.

17. The electrical shock-proof fuse holder as defined in claim 16, wherein:

said carrier member when locked in said work position being completely inserted into said housing such that said carrier member can only be released with the assistance of a tool; and said carrier member when assuming each of said released position and said rest position at least partially protruding from said housing.

18. The electrical shock-proof fuse holder as defined in claim 17, wherein:

said carrier member is structured such that said fuse insert when received in said cradle is arranged substantially parallel but eccentrically with respect to said predetermined lengthwise axis of said receiving tube.

19. The electrical shock-proof fuse holder as defined in claim 18, wherein:

said cradle member is devoid of any opening.

20. The fuse holder as defined in claim 19, further including:

said housing comprises two walls;

one of said two walls being provided with said opening;

said two walls defining a slit therebetween which is disposed at opposite sides of said opening provided at said one wall of said receiving tube and extending in circumferential direction;

a respective electrical connection conductor extending substantially parallel to said predetermined lengthwise axis and disposed in said slit at each of said opposite sides of said opening;

each of said electrical connection conductors leading a related one of said external connecting parts to a related one of said contact pieces;

a respective frame conductor part connected to each electrical connection conductor and extending in said circumferential direction; and each of said contact pieces, viewed radially towards said predetermined lengthwise axis, extending substantially parallel to said predetermined lengthwise axis and projecting inwardly from said frame conductor part thereof.

* * * * *